United States Patent [19]

Otto, Jr., deceased et al.

[11] 4,165,205

[45] Aug. 21, 1979

[54] MULTI-STAGE PUMP

[76] Inventors: Carl L. Otto, Jr., deceased, late of Lummi Island, Wash.; by Phyllis Lockwood, executrix, 2095 W. Shore Dr., Lummi Island, Wash. 98262

[21] Appl. No.: 798,462

[22] Filed: May 19, 1977

[51] Int. Cl.[2] ..... F04B 3/00; F04B 17/04; F04B 21/02

[52] U.S. Cl. ..... 417/262; 417/265; 417/266; 417/267; 417/418; 417/566

[58] Field of Search ..... 417/254, 256, 257, 259, 417/262, 265, 266, 267, 566, 415, 410, 417, 418

[56] References Cited

U.S. PATENT DOCUMENTS

| | | | |
|---|---|---|---|
| 1,217,195 | 2/1917 | McFerren | 417/256 |
| 1,366,151 | 1/1921 | Aftrom | 417/566 |
| 1,615,140 | 1/1927 | Rufdell | 417/256 |
| 1,844,261 | 2/1932 | Penrod | 417/260 |
| 2,788,170 | 4/1957 | Kats | 417/413 |
| 3,077,162 | 2/1963 | Banerian | 417/267 |
| 3,514,221 | 5/1970 | Hasguenoph et al. | 417/206 |
| 3,924,165 | 12/1975 | Otto | 318/132 |

FOREIGN PATENT DOCUMENTS

| | | | |
|---|---|---|---|
| 253981 | 7/1963 | Australia | 417/256 |
| 1055010 | 4/1959 | Fed. Rep. of Germany | 417/265 |
| 1416884 | 12/1975 | United Kingdom | 417/254 |

*Primary Examiner*—Carlton R. Croyle
*Assistant Examiner*—Richard E. Gluck

[57] ABSTRACT

A multi-stage pumping assembly comprising a plurality of pumping units arranged end to end in an elongate cylindrical housing. Each pumping unit comprises a solenoid which when energized causes a pumping piston to retract downwardly on its intake stroke, and when de-energized permits a tension loaded rubber sleeve element to pull the piston upwardly on its discharge stroke. Each of the solenoids is energized in sequence so that the pumping pistons move through their pumping cycles in a sequential pattern. In pumping against lower pressures, each piston is able to move through a longer path of travel on its discharge stroke to effect a higher volumetric flow of liquid. When working against higher head pressures, the pressure exerted by the several pumping pistons, working cumulatively effects a lower volumetric flow of fluid at a higher pressure.

10 Claims, 10 Drawing Figures

FIG. 4
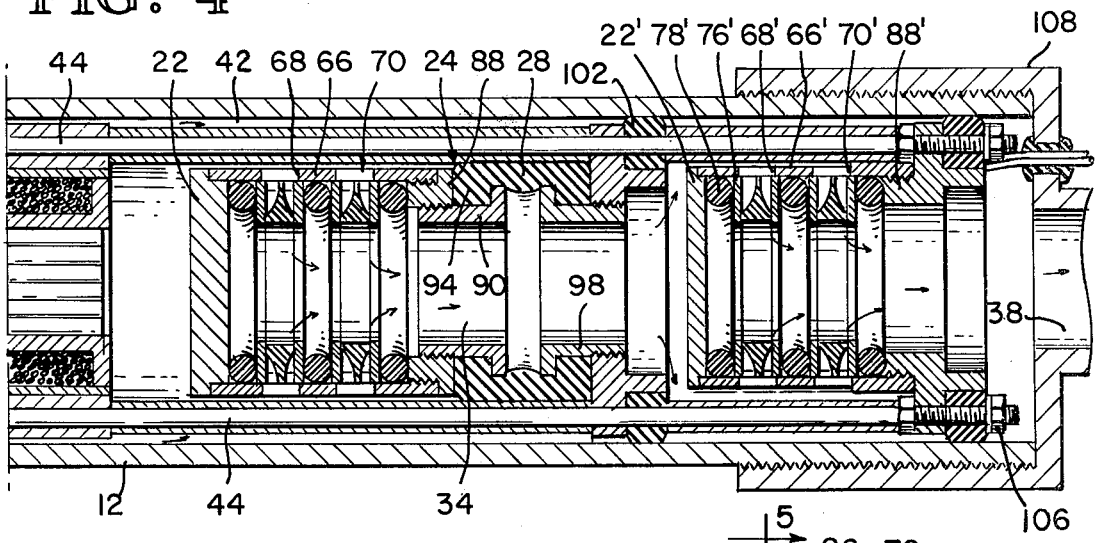
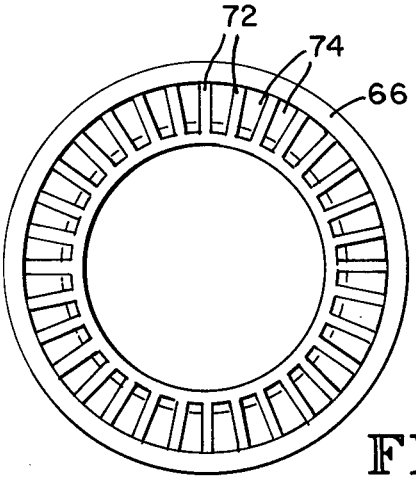
FIG. 5
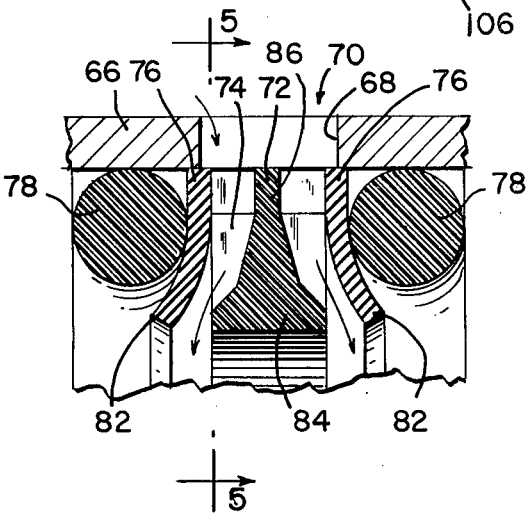
FIG. 6
FIG. 7
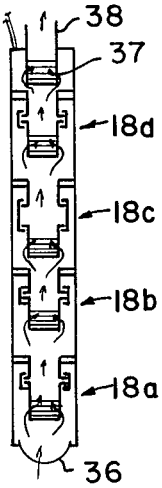
FIG. 8
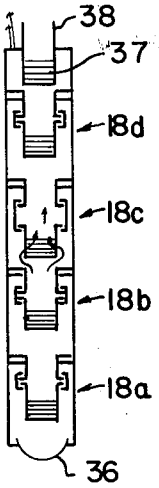
FIG. 9
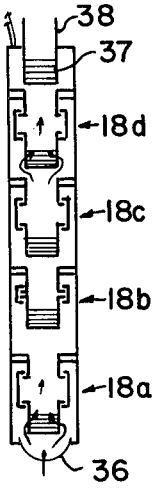
FIG. 10
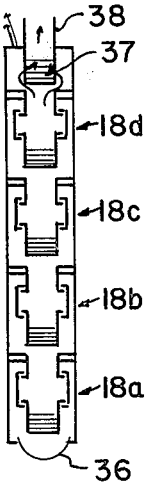

MULTI-STAGE PUMP

BACKGROUND OF THE INVENTION

A. Field of the Invention

The present invention relates to a multi-stage pump, particularly adapted to operate in bore holes of relatively small width and able to operate effectively against a varying magnitude of pressure head.

B. Brief Description of the Prior Art

A typical reciprocating pump utilizes a reciprocating piston which on an intake stroke causes a flow of water through a check valve into a pumping chamber, and on a discharge stroke moves the fluid from the pumping chamber along the desired flow path. Pumps of this general type have been arranged in multi-stage assemblies, such as that shown in U.S. Pat. No. 1,844,261, Penrod. In that patent, the several pumping units are arranged in end to end relationship, and the several pistons of the pumping units are rigidly interconnected with one another to operate in unison. Thus, the lower or downstream side pumping units experience lesser back pressure, while the uppermost pumping unit experiences the full back pressure against which the pumping assembly operates.

Also, there are known in the prior art various devices which utilize electric power to activate a solenoid to cause a pumping action. Such a device is shown in the Kato et al patent, U.S. Pat. No. 2,788,170, this particular device being adapted for use as an aquarium pump. Representative of yet another pumping configuration is the Hasquenoph et al patent, U.S. Pat. No. 3,514,221.

While there are a wide variety of prior art pumps especially adapted for specialized applications, there is a continuing need for improvement in such pump designs. Accordingly, it is an object of the present invention to provide a multi-stage pump which is quite simple in its basic operating components and its overall configuration, is able to fit in a relatively small diameter hole, is able to operate on a fluid which contains abrasive particles (such as well water having small particles of sand therein) and is able to operate either at a high volumetric flow rate against lower pressure head or at lower volumetric flow rates at higher pressure heads.

SUMMARY OF THE INVENTION

In the multi-stage pump assembly of the present invention, there is a housing means having an intake pumping chamber and a plurality of additional pumping chambers arranged in series for liquid flow into the intake chamber and sequentially through the additional pumping chambers. There are a plurality of pumping elements, each having a downstream face exposed to pressurized fluid from an immediately adjacent downstream pumping chamber and an upstream face exposed to liquid pressure from an immediately adjacent upstream pumping chamber.

For each of said pumping elements, there is a separately operable actuating means to move its related pumping element on a pumping cycle in a first direction on an intake stroke and to urge its related pumping element in a second direction on a discharge stroke. Also, there is a check valve for each pumping chamber to its related upstream pumping chamber, but preventing reverse flow from an upstream pumping chamber to a downstream chamber. Activating means operatively connected to the actuating means causes each of the actuating means to operate in sequence so as to move said pumping elements sequentially through their pumping cycles.

In the preferred form, each actuating means comprises a first retracting means to move its pumping element on its intake stroke, this retracting means desirably being a solenoid. Also, the actuating means comprises a resilient sleeve having a first end secured to the housing and a second end secured to its related pumping element. Each sleeve defines at least a portion of the pumping chamber upstream of its related pumping element.

In the preferred configuration of the check valve of the present invention, there is at least one circumferential ring member surrounding a related chamber, each ring member being provided with radial grooved passageways for flow of fluid therethrough. There is at least one annular flap member having a closed position against the ring member to close the grooved passageways, and an open position wherein a radially inward portion of the flap member is deflected away from the grooved passageways. In the particular configuration shown herein, there is a plurality of such ring members, with grooved passageways being formed on both sides of each ring member. Likewise, there are flap members on each side of each ring member, and compression ring members positioned against the radially outward portions of the flap members.

The several pumping units can be quite conveniently assembled by providing the housing in the form of an elongate tubular member and providing one or more mounting rods lengthwise in the housing. The several solenoids and sleeve members are each mounted to said rod means and located in their proper positions by suitable locating means along the length of the one or more rods. These locating means can be provided quite conveniently in the form of seal ring members which are compressed axially to bear against the tubular housing to locate the solenoids and sleeve members while providing partitions between adjacent pumping chambers.

Other features of the present invention will become apparent from the following detailed description.

BRIEF DESCRIPTION OF THE DRAWINGS

FIG. 4 is a longitudinal sectional view of the outlet end of the pumping assembly;

FIG. 5 is a transverse sectional view taken through line 5—5 of FIG. 4, illustrating the construction of the check valve of the present invention;

FIG. 6 is a sectional view taken along line 6—6 of FIG. 5 and showing in an enlarged scale one of the valve elements of the check valve shown in FIG. 5; and FIG. 7 through 10 are schematic drawings showing different operating conditions of the valve assembly.

DETAILED DESCRIPTION OF THE PREFERRED EMBODIMENT

It is believed that a clearer understanding of the present invention will be achieved by first describing the main operating components, and then describing in further detail the physical details and precise mode of operation of the present invention.

Figure 1:
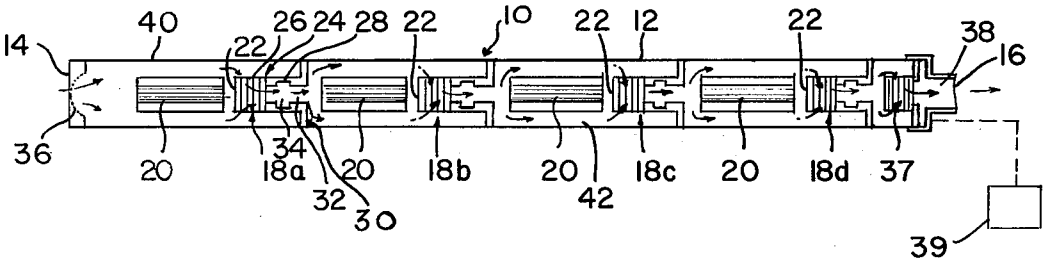
FIG. 1 is a semi-schematic longitudinal sectional view showing the main operating components of the pumping assembly of the present invention.

In FIG. 1, there is shown a semi-schematic drawing of the pump assembly, generally designated 10, and comprising a cylindrical housing 12 having an intake end 14 and a discharge end 16. In describing the components of the present invention, the terms "lower" or "rearward" will denote proximity to the intake end 14 while the terms "upper" or "forward" denote proximity to the discharge end 16. The term "inner" denotes proximity to the longitudinal center line of the housing 12, and the term "outer" denotes a location radially outward from the longitudinal center line.

Mounted within the housing 10 are a plurality of pumping units which in the present embodiment are shown as four units, designated 18*a*, 18*b*, 18*c* and 18*d*, with 18*a* being the lowermost unit on the "upstream" or intake end of the pump and pumping unit 18*d* being at the "downstream" or discharge end 16. Each pumping unit 18 comprises a solenoid 20 and a pumping piston 22 made of an electromagnetic material and positioned a short distance upwardly from the solenoid 20. The unit 18 further comprises a sleeve member 24 having at its lower end a check valve assembly 26 and at its upper end an elastic or resilient actuating member 28. The sleeve member 24 is mounted at its forward end to a transverse seal member 30, which provides an upward opening 32 leading from the chamber 34 defined by the sleeve member 24, but which forms a fluid seal in the annular area between the forward end of the sleeve member 24 and the housing 12.

At the intake end 14 there is a screen 36 to prevent entry of large particles into the pump housing 12. At the outlet end 16 there is an uppermost check valve 37, similar in construction to the check valve assemblies 26 of the several units 18*a-d* and a discharge pipe 38. To indicate at this time the mode of operation of the present invention somewhat briefly, when the lowermost solenoid 20 is activated, its related piston 22 is attracted to the solenoid 20 and thus moves downwardly to stretch its resilient element 28. This causes an enlargement of the volume of the chamber 34 defined by the sleeve element 24, so that fluid from the intake chamber 40 flows through the check valve assembly 26 and into the first pumping chamber 34. Upon deactivation of the same solenoid 20, the urging of the elastic member 28 moves the pumping piston 22 upwardly on its discharge stroke to decrease the volume in the chamber 34 and move the fluid in the chamber 34 through the opening 32 into the annular chamber 42 which surrounds the components of the second stage pumping unit 16*b*. As the fluid flows into the annular chamber 42 it passes through the second stage discharge chamber 34, and so on upwardly through the pump assembly and out the conduit 38 at the discharge end 16 of the assembly 10.

Each of the pumping units 16*a* through 16*d* is operated in a sequential pattern. That is to say, one solenoid 20 is energized for a sufficient length of time to retract its related piston 22 to its full down position against the solenoid 20, and the deactivated to permit its related elastic actuating member 28 to move its related piston 22 upwardly on a discharge stroke. Then a second solenoid 20 of one of the other pumping units 18*a* through 18*d* is likewise activated for a short time to move its related piston 22 downwardly and then permit it to move upwardly on its pumping cycle, and so on with regard to the remaining two solenoids 20 of the third and fourth pumping units 16.

An apparatus to act as a power source for the units 18*a* through 18*d* is indicated schematically at 39 in FIG. 1. Such an apparatus suitable for providing sequential electrical pulses to power the solenoids 20 is disclosed in U.S. Pat. No. 3,924,165, with the inventor in that apparatus also being Carl L. Otto, Jr. This apparatus is particularly adapted to work off a 60 cycle electrical input to energize the four units sequentially. Electrical connection to the solenoids can be accomplished quite easily by means of wires placed within the housing 12. While the apparatus 39 is shown schematically as being located exteriorly of the housing, it could be formed in an annular configuration and placed within the housing.

As will be disclosed more fully hereinafter, the particular configuration of the pumping assembly 10 operates at a higher volumetric flow rate when working against a lower pressure head, and has the capability of also pumping against a much higher pressure head, but at a lower volumetric flow rate.

The physical components of the present invention will now be described in more detail. The cylindrical housing 12 can be provided quite simply in the form of a piece of cylindrical plastic tubing open at both ends and having a nominal diameter of, for example, two inches. To mount the components of the four pumping units 18*a* through 18*d*, there are provided four rods 44 positioned just inwardly of the wall of the housing 12 and extending substantially the entire length of the housing 12.

At the inlet end 14 of the housing 12, the intake screen 36 is mounted by a peripheral flange portion to a metal ring 46, held in place by four nuts 48, threaded onto the bottom end of the rod 44. Positioned upwardly of the ring 46 is a seal ring 50 positioned between the lower retaining ring 46 and an upper retaining ring 52. When the entire pumping assembly 10 is assembled and the lower nuts 48 are tightened, the two rings 46 and 52 squeeze the yielding seal ring 50 to form a tight seal at the annular area surrounding the opening at the location of the intake screen 36.

Figure 2:
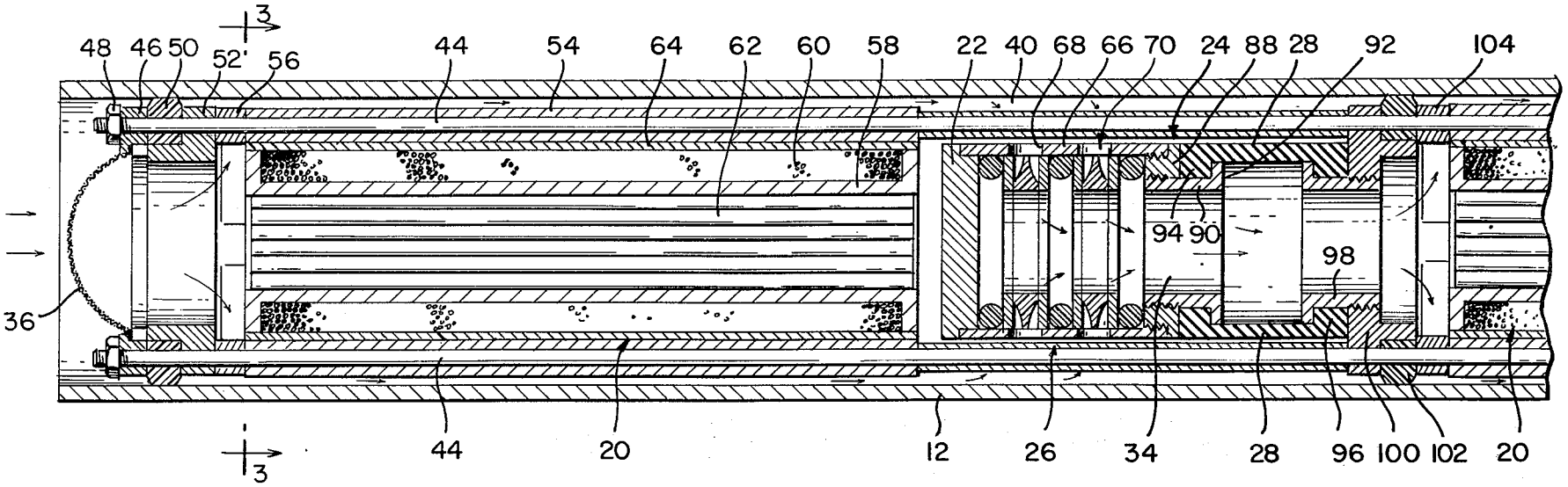
FIG. 2 is a longitudinal sectional view of a first-stage unit of the pumping assembly of the present invention.
Figure 3:
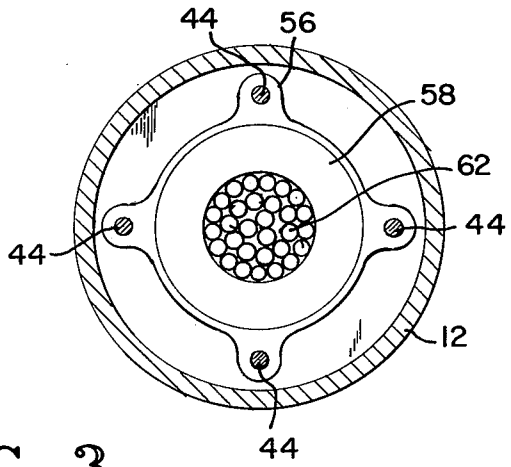
FIG. 3 is a transverse sectional view taken through line 3—3 of FIG. 2.

Upwardly from the spacing ring 52 are four spacing sleeves 54, each one of which surrounds a related one of the mounting rods 44. The solenoid 20 is located inside of the four spacing elements 54 and is mounted to the rods 44 by means of ears 56 which are shown more clearly in FIG. 3. The solenoid 20 is or may be of conventional design and is shown herein comprised as a spool member 58 around which copper wire 60 is wound, and containing a ferro magnetic core 62. The conducting wire 60 is surrounded by a fluid tight envelope 64; desirably made of a ferro magnet material.

The piston 22 has a disc-like configuration, and it fits just inside the four mounting rods 44 at a location a short distance upwardly of the solenoid 20. As indicated previously herein, connected to and extending upwardly from the piston 22 is the sleeve member 24 made up of a lower check valve assembly 26 and an upper elastic actuating member 28.

The check valve assembly 26 comprises a rigid cylindrical member 66 having a plurality of circumferential holes 68. Within the cylindrical member 66 there are two check valve ring assemblies 70, each of which is positioned at the location of a related set of circumferential holes 68. One such ring assembly 70 can be seen more clearly with reference to FIGS. 5 and 6. As shown in FIG. 6, there is a middle, more rigid ring 72 having a plurality of circumferential cutouts 74. On opposite sides of the ring 72 are two more flexible rings 76 having a relatively small thickness dimension. On opposite sides of the ring assembly 70, there are a pair of compression rings 78 which press against the radially outward portion of the center ring 72, but permit the radially inward portions 82 of the rings 72 to deform outwardly or away from the center ring 72.

In effect the ring 72 defines a plurality of flow passages 74, each of which begins at an outward location of the ring 72 and terminates at a laterally inward location of the ring 72. At the location of the cutouts or flow passages 74, the ring 72 has a cross-sectional configuration resembling a conventional golf tee having an expanded inward head portion 84 and a relatively narrow outer portion 86. When there is greater pressure outside of the cylindrical member 66, fluid passing into the passageways or cutouts 74 deflects the inward portions 82 of the flap rings 76 outwardly to permit flow of the fluid inwardly through the cylinder 66 (this occurring on the downward or intake stroke of the associated piston 22), and when there is a higher pressure within the cylindrical member 66, the inner edges of the two flap rings 76 are held tightly against the inner portion 84 of the ring member 72, to form a tight seal therewith (this occurring on the discharge stroke of the associated piston 22).

Connected to the forward end of the member 66 is a ring 88, to which is threadedly connected a second ring 90 having an outwardly extending annular flange 92. In an annular recess defined by these two rings 88 and 90, there is retained an annular protrusion 94 at the lower end of the aforementioned elastic actuating member 28. This member 28 is able to stretch in a lengthwise direction, but should be substantially non-elastic with regard to any possible lateral expansion. This could be accomplished by providing the member 28 with reinforcing strands located circumferentially around the member 28. This member 28 has at its forward end a second protruding portion 96 which is in turn retained by two rings 98 and 100, which are similar in construction to the aforementioned rings 88 and 90. Forwardly of the ring 100, there is a seal member 102, similar to the seal 50 at the intake end of the housing 12 and an upper retaining ring 104. Forwardly of the retaining ring 104 there is a second solenoid 20 of the second upper pumping unit 18*b*. The components of the other pumping units 18*b*, *c* and *d* are substantially the same as those described with respect to the lower unit 18, so no detailed description of these other pumping units 18*b* through *d* is believed to be needed herein. Located above the final pumping unit 18*d*, there is the aforementioned check valve 37, which can be seen more clearly in FIG. 4. Since the components of this check valve 37 are substantially the same as those of the previously described check valve assemblies 26, these will not be described in detail herein, but will be given numerical designations corresponding to those of the components of the assemblies 26, with a prime (') designation distinguishing those of the valve 37.

The operation of the single pumping unit 18*a* is readily understandable, it is believed, from the foregoing description with reference to FIG. 1. However, to review this briefly at this point, it can be seen that as the piston 22 moves downwardly by activation of the solenoid 20, the elastic cylindrical member 28 elongates, to increase the volume of the chamber 34 defined by the elastic member 28 and the other cylindrical member 66. This in turn causes an inflow from the annular area 40 through the cutouts or passageways 74 in the two check valve ring assemblies 70, with this inflow causing the flap rings 82 to deflect away from the center ring member 72 to permit fluid flow to the inside pumping chamber 34. Upon deactivation of the solenoid 20, the piston 22 is urged upwardly to travel on its discharge stroke by the force exerted by the elastic member 28. This causes an increase of pressure in the pumping chamber 34 to close the flap rings 82 against the middle ring 72, and discharge the fluid upwardly from the chamber 34.

With regard to assembling the components of the present invention, it can be seen that each pumping unit 18*a* through 18*d* comprises essentially a solenoid 20 and a piston and sleeve member 22–24, each having its associated mounting and retaining rings. These units can quite easily be slipped onto the four mounting rods 44 in the proper sequence. With all the components in place, the four nuts 48 at the bottom of the assembly are tightened along with the four nuts 106 at the upper end of the assembly (as seen in FIG. 4) to hold the components firmly in place and press the seal members 50 and 102 in proper sealing relationship. As shown in FIG. 4, an adapting connector 108 can be attached to the discharge end of the housing 12 to provide a seal connection of the discharge pipe 38.

As was disclosed previously herein, one of the advantages of the present inventioon is that it is capable of operating at higher volumetric flow rates against a lower pressure head, and yet capable of operating effectively under conditions of a much higher pressure head, but at a lower volumetric flow rate. This particular operating feature can be understood more readily with reference to FIGS. 7 through 10. For ease of illustration, the solenoids 20 are not shown.

In the operating condition in FIG. 7, let it be assumed that the pumping assembly 10 is adequately primed (i.e., the chambers in the pumping units 18*a* through 18*d* are filled with water), and that the pressure at the outlet conduit 38 is at a relatively lower level. With each of the pistons 22 in its full up position, its related actuating sleeve is substantially unstressed and this exerts very little, if any, upward force. In this condition, let it be assumed that one of the pumping units, for example 18*c*, is activated. The related piston 22 is moved on the intake stroke to its lower position so that there is flow of fluid in the lower pumping chamber 34 of the unit 18*b* into the pumping chamber of the pumping unit 18*c*. As soon as the solenoid 20 of the unit 18*c* is deactivated, the force of the elastic actuating member 28 is sufficient to move the piston 22 upwardly to force liquid in the chamber 34 through the valve assembly of the next upper unit 18*d* and upwardly through the conduit 38. At the same time, liquid is drawn in through the intake screen 36 upwardly into the two pumping chambers of the lower two units 18*a* and 18*b*. Thus, through an entire pumping cycle, where each of the four units 18*a* through 18*d* are activated in sequence, each of the pistons 22 goes through its pumping cycle in sequence, and the total volumetric flow is equal to four times the pumping capacity of each of the four pumping chambers 34 when the associated pistons 22 moves through its stroke.

Now let it be assumed that the pumping assembly 10 has not been operated for a period of time, and because of directing the outlet of the conduit 38 into a higher pressure area, there is a much higher back pressure against the assembly 10. As shown in FIG. 8, let it be assumed that, as in the previous example, pumping unit 18*c* is activated. The solenoid 20 moves the associated piston downwardly on its intake stroke, but on deactivation of the solenoid 20, the elastic actuating member 28 does not have adequate force to work against the pressure in the system to cause the piston 22 of the unit 18*c* to move upwardly on its discharge stroke. Subsequently, as shown in FIG. 9, two other pumping units are activated, namely 18*d* and 18*a*. As each of the pistons 22 of these units moves downwardly, fluid flows into the related pumping chamber 34, and each of the elastic actuating members 28 of the three pumping units 18*a*, 18*c* and 18*d* are urging the fluid in the system upwardly. It is important to note that the force exerted by the three elastic actuating members 28 which have been elongated is cumulative. Thus, the pressure in the lowermost chamber 34 of pumping unit 18*a* creates a pressure which is substantially uniform and is exerted against the lower side of the piston 22 of the third pumping unit 18*c*. This pressure on the bottom side of the third uppermost piston 22, along with the force exerted by the elastic actuating member 28 of the third unit 18*c* is cumulative to cause a yet higher pressure in the chamber 34 of the third unit 18*c*. This in turn is exerted against the uppermost piston 22 of the fourth pumping unit 18*d*, and this is added to the further pressure increment contributed by the elastic actuating member 28 of the uppermost unit 18*d*.

However, let it be assumed that even under the condition of FIG. 9, the back pressure existing in the discharge tube 38 is still high enough to overcome the total pressure provided by the cumulative effect of the pumping units 18*a*, 18*c* and 18*d*. At this point, as shown in FIG. 10, the fourth pumping unit 18*b* is activated, to add a fourth pressure increment to the total system, and in the particular example shown herein, this is sufficient to cause an increment of flow upwardly through the discharge conduit 38. As the pumping assembly 10 continues to operate under this high back pressure condition, it can be expected that the assembly 10 will reach a stabilized operating condition, where activation of each of the pumping units 18*a* through 18*d* causes a movement of its related piston 22 through a shorter increment of travel, and that there is a certain small flow increment with activation of each of the units 18*a* through 18*d*, with a correspondingly shorter travel of each of the pistons 22.

In view of the foregoing description, it can be readily appreciated that the operating components of the present invention are relatively simple in structure, and are also quite easy to assemble in operating condition. Also, additonal pumping units can be added to the assembly quite easily for increased capacity. These individual pumping units are so arranged so that the pump can be positioned within a hole of very small diameter. The particular arrangement of the pumping components is such that the presence of abrasive particles such as sand in water, would be less harmful to the pumping assembly of the present invention in comparison to many prior art pump configurations.

What is claimed is:

1. A multi-stage pump assembly comprising:

a. housing means having an intake pumping chamber and a plurality of additional pumping chambers arranged in series for liquid flow into said intake pumping chamber and sequentially through the additional pumping chambers, b. a plurality of pumping elements, each having a downstream face exposed to pressurized fluid from an immediately adjacent downstream pumping chamber and an upstream face exposed to liquid pressure from an immediately adjacent upstream pumping chamber, c. a plurality of separately operable actuating means, one for each of said pumping elements to move its related pumping element in a pumping cycle in a first direction on an intake stroke and to urge its related pumping element in a second direction on a discharge stroke, d. a plurality of check valves, one for each pumping chamber, each check valve permitting an inflow of fluid from an upstream pumping chamber to a downstream pumping chamber, but preventing reverse flow from a downstream pumping chamber to an upstream chamber, e. activating means operatively connected to each of said actuating means to cause each of said actuating means to operate in sequence so as to move said pumping elements sequentially through their pumping cycles.

2. The pump assembly as recited in claim 1, wherein each of said actuating means comprises a first retracting means to move its related pumping element in said first direction on the intake stroke, and second resilient means to urge the pumping element in said second direction on its discharge stroke.

3. The assembly as recited in claim 2, wherein each of said resilient means comprises a resilient sleeve member having a first end secured to said housing means and a second end secured to its related pumping element, each sleeve member defining at least a portion of the pumping chamber downstream of its related pumping element.

4. The assembly as recited in claim 2, wherein each of said first retracting means comprises a solenoid which is electrically actuated to move its related pumping element in said first direction on its intake stroke.

5. The assembly as recited in claim 2, wherein each of said resilient means comprises a resilient sleeve member having one end secured to said housing and a second end secured to its related pumping element, each sleeve member defining at least a portion of the pumping chamber downstream of its related pumping element, and said first retracting means comprises a solenoid which is electrically actuated to move its related pumping element in said first direction on its intake stroke.

6. The pump assembly as recited in claim 1, wherein each of said check valves comprises at least one circumferential ring member surrounding its related chamber, said ring member provided with radial grooved passageways for flow of fluid therethrough, and at least one annular flap member having a closed position against said ring member to close said grooved passageways, and an open position wherein a radially inward portion of said flap member is deflected away from said grooved passageways.

7. The pump assembly as recited in claim 6, wherein each of said check valves further comprises a compression ring pressing against a radially outward portion of said flap member to urge it into contact with said ring member, while permitting deflection of the radially inward portion of said flap member.

8. The pump assembly as recited in claim 6, wherein each of said check valves comprises a plurality of said ring members, each having grooved passageways on opposite sides thereof and each being provided with two flaps on opposite sides thereof, each of said check valves each having compression ring members pressing radially outward portions of said flap members against related ring members, while permitting deflection of radially inward portions of said flap members.

9. The pump assembly as recited in claim 1, wherein a. each of said actuating means comprises a first retracting means to move its related pumping element in said first direction on the intake stroke, and second resilient means to urge the pumping element in said second direction on its discharge stroke, b. each of said resilient means comprises a resilient sleeve member having a first end secured to said housing means and a second end secured to its related pumping element, each sleeve member defining at least a portion of the pumping chamber downstream of its related pumping element, c. each of said first retracting means comprises a solenoid which is electrically actuated to move its related pumping element in said first direction on its intake stroke, d. said housing comprises an elongate tubular member, e. said pump assembly has mounting rod means extending lengthwise in said tubular member, the solenoid and resilient sleeve of each of said pumping units being mounted to said rod means, and f. locating means to position the solenoids and sleeve members at proper locations along the length of said rod means.

10. The pump assembly as recited in claim 9, wherein said locating means comprises seal ring members with means to compress said seal ring members axially to bear against said tubular housing to locate said solenoids and sleeve members while providing partitions between adjacent pumping chambers.

* * * * *